US011666085B2

(12) United States Patent
Roth

(10) Patent No.: US 11,666,085 B2
(45) Date of Patent: Jun. 6, 2023

(54) DEVICE FOR FILLING PAPER TUBES WITH TOBACCO

(71) Applicant: Bernhard Roth, Grein (AT)

(72) Inventor: Bernhard Roth, Grein (AT)

( * ) Notice: Subject to any disclaimer, the term of this patent is extended or adjusted under 35 U.S.C. 154(b) by 126 days.

(21) Appl. No.: 16/765,105

(22) PCT Filed: Nov. 20, 2018

(86) PCT No.: PCT/AT2018/060273
§ 371 (c)(1),
(2) Date: May 18, 2020

(87) PCT Pub. No.: WO2019/100093
PCT Pub. Date: May 31, 2019

(65) Prior Publication Data

US 2020/0345062 A1 Nov. 5, 2020

(30) Foreign Application Priority Data

Nov. 23, 2017 (AT) ..... A461/2017

(51) Int. Cl.

| | |
|---|---|
| ***A24C 5/40*** | (2006.01) |
| ***A24C 5/42*** | (2006.01) |
| ***A24C 5/06*** | (2006.01) |
| *A24C 5/46* | (2006.01) |
| *A24D 3/04* | (2006.01) |

(52) U.S. Cl.
CPC ..... *A24C 5/40* (2013.01); *A24C 5/06* (2013.01); *A24C 5/42* (2013.01); *A24C 5/465* (2013.01); *A24D 3/04* (2013.01)

(58) Field of Classification Search
CPC .... A24C 5/06; A24C 5/40; A24C 5/42; A24C 5/425; A24C 5/465
See application file for complete search history.

(56) References Cited

U.S. PATENT DOCUMENTS 622,142 A * 3/1899 Gravely ..... A24C 5/42 206/253
1,233,850 A * 7/1917 Delevanti ..... A24C 5/42 206/253

(Continued)

FOREIGN PATENT DOCUMENTS

DE 3427480 A1 2/1986

OTHER PUBLICATIONS

International Search Report and Written Opinion in International Application No. PCT/AT2018/060273, dated Feb. 28, 2019, 13 pages.

*Primary Examiner* — Francisco W Tschen
*Assistant Examiner* — Sonny V Nguyen
(74) *Attorney, Agent, or Firm* — Liang & Hennessey LLP; Brian Hennessey

(57) ABSTRACT

The invention relates to a device for filling paper tubes with tobacco, comprising an attachment for receiving the paper tube, a pressing tool guided by a guide unit with a pressing die, the device comprising a container for receiving tobacco with a container outlet, the pressing die being movable from a first position, in which first position the bore is released, into a second position for introducing the tobacco into the paper tube, and the attachment, the container outlet and the guide unit being arranged along an axis.

18 Claims, 7 Drawing Sheets

(56) References Cited

U.S. PATENT DOCUMENTS

| | | | | | |
|---|---|---|---|---|---|
| 1,771,308 | A | * | 7/1930 | Newman | A24C 5/42 131/75 |
| 1,885,304 | A | * | 11/1932 | Stranger | A24C 5/42 131/70 |
| 1,905,652 | A | * | 4/1933 | Sabourin | A24C 5/42 131/75 |
| 2,125,351 | A | * | 8/1938 | Lytle | A24C 5/42 131/75 |
| 3,124,141 | A | * | 3/1964 | Seitter | A24C 5/42 131/70 |
| 4,534,367 | A | | 8/1985 | Newsome | |
| 4,632,129 | A | * | 12/1986 | Kastner | A24C 5/42 131/70 |
| 2018/0213838 | A1 | * | 8/2018 | Richmond | A24B 7/04 |
| 2020/0329756 | A1 | * | 10/2020 | Karim | A24C 5/465 |

* cited by examiner

DEVICE FOR FILLING PAPER TUBES WITH TOBACCO

CROSS-REFERENCE TO RELATED APPLICATIONS

The present application is a national phase application of PCT Application No. PCT/AT2018/060273, filed Nov. 20, 2018, entitled "DEVICE FOR FILLING PAPER TUBES WITH TOBACCO", which claims the benefit of Austrian Patent Application No. A461/2017, filed Nov. 23, 2017, each of which is incorporated by reference in its entirety.

BACKGROUND OF THE INVENTION

1. Field of the Invention

This invention relates to a device for filling a paper tube with a tobacco mixture including an attachment for receiving the paper tube, a pressing tool having a pressing die, the pressing tool being guided by a guide unit.

2. Description of the Related Art

In the context of the disclosure of the invention, no distinction is made between the terms tobacco and tobacco mixture, unless one of these terms is implicitly or explicitly referred to.

DE8326921U1 relates to a device for transferring tobacco from a cylindrical wrapping into a cigarette paper tube. In contrast to the invention described below, in which the tobacco is introduced into the container in a free state, DE8326921U1 deals with the use of so-called tobacco cartridges.

In the device disclosed in DE3427480A1, a freely movable stuffing arm is used, wherein the tobacco is brought, without any guidance of the stuffing arm, from the storage chamber into the tobacco stuffing chamber with the help of the end of the stuffing arm used for stuffing the tobacco. Even when the stuffing arm enters the tobacco stuffing chamber, guidance of the stuffing arm is neither implicitly nor explicitly disclosed in DE3427480A1.

CA2173575 discloses an apparatus for stuffing a cigarette comprising a paper tube, a filter inserted therein and tobacco. It is not the task of the device to fill the paper tube with tobacco, which is why the device does not comprise a container comprising stored tobacco.

DE202009006864U1 discloses a device for stuffing a cigarette, in which device a paper tube placed through a mouthpiece is inserted into the tobacco compartment. DE202009006864U1 therefore does not disclose a guided pressing tool.

The manual rolling of cigarettes requires a lot of skill. The user must place exactly the right amount of tobacco on a piece of paper, which must then be turned into a sleeve enclosing the tobacco and glued in this form to its jacket edge. The user may also have to insert a filter and rotate the paper around the filter and tobacco. To rotate the paper, the user has to lift the paper together with the tobacco and, if necessary, the filter from a support, wherein some tobacco usually falls off the paper. For this reason, manually rolling cigarettes is a messy process.

Furthermore, paper tubes are known from the prior art, which paper tubes are stuffed with tobacco. The user can use funnel-shaped devices, the tobacco being introduced into the paper tube using a pressing tool. In no device according to the prior art, however, is the pressing tool guided in a device according to the invention described below.

SUMMARY OF THE INVENTION

The object of the invention disclosed below is to provide a device for easier manual and cleaner filling of paper tubes.

According to the invention, this is achieved by a device, which device comprises a container for receiving tobacco with a container outlet, wherein the pressing die is movable from a first position, in which first position the bore is released, into a second position for introducing and/or stuffing the tobacco into the paper tube, and wherein the attachment, the container outlet and the guide unit are arranged along an axis.

The device includes several elements. The person skilled in the art can provide suitable connections in order to connect these elements by means of, for example, plug connections, screw connections, and/or snap-in connections.

Parts of the elements of the device can be made of a transparent material. This allows the user to operate the device according to the invention more easily.

Parts of the elements of the device can be made of a material with a moisture fluctuation compensating effect, such as wood. In particular, the container can be made of wood.

The elements of the device can be made of metal or plastic, for example.

In the first position of the pressing tool, the tobacco can pass from the container space through the hole in the attachment and thus through the discharge opening into the paper tube.

The feature of the continuous alignment of the elements is to be understood in such a way that this feature is fulfilled when the pressing tool comes into contact with the tobacco, since in this case the tobacco is inserted into and/or stuffed into the paper tube. This is also the function of the device according to the invention.

The invention is thus characterised in that the elements of the device and the paper tube are brought into exact positions relative to one another and are held in these exact positions while the paper tube is being filled with tobacco. This enables a clean filling of the paper tube with tobacco.

The pressing tool is guided by a linear guide provided in the area of the container. The linear guide can be designed such that, in addition to the linear movement of the pressing tool, it also allows a rotating movement of the pressing tool about the longitudinal axis of the pressing tool or prevents this rotating movement.

The attachment can be designed as no guide of the pressing tool. There is an annular gap between the pressing tool and the inner surface of the attachment. However, if the skilled person deems it necessary to also design the attachment as a guide for the pressing tool, he can do this by way of design of the inner surface of the attachment. The disclosure of the invention is not restricted to the fact that an annular gap must be arranged between the pressing tool and the attachment.

The arrangement of the attachment, the container outlet and the guide unit along an axis includes that the pressing tool is also arranged along this axis and can be moved along this axis from the first position to the second position.

Stuffing tobacco is to be understood as a compression process of the tobacco.

The invention described in the context of this disclosure is also characterised in that a quantity of tobacco is received by the pressing die. This quantity of tobacco is introduced centrally into the paper tube and/or stuffed into the same by the guided pressing tool.

The attachment can have a smaller diameter than the paper tube in the region of the first attachment end, which first attachment end is the distal end in relation to the other elements of the device.

The paper tubes have a customary and thus known diameter. This ensures that the paper tube can be applied to the attachment.

The pressing die can be lockable in the first position and in the second position.

In the first position, the pressing die, and thus also the pressing tool, is located in a position that is pulled out of the container.

The pressing die can be brought into this position to fill the container with tobacco or a tobacco mixture. In this case, the pressing tool is not a hindrance when filling the container. The pressing die can be lockable in this first position by a releasable connection.

The pressing tool can be brought into this position in order to unblock the bore and thus to allow the tobacco to slide through the bore into the attachment, possibly by shaking, and thus to allow the tobacco to slide through the discharge opening into the paper tube.

The pressing die can fundamentally have an outer diameter equal to the inner diameter of the discharge opening in the first attachment end. The pressing die thus closes this discharge opening and thus prevents the tobacco stored in the interior of the container from drying out via this discharge opening. The pressing die is preferably locked in this second position by a releasable connection.

The pressing die can essentially have an outer diameter smaller than the inner diameter of the discharge opening in the first attachment end. When the pressing die is positioned in the discharge opening, an annular gap thus remains between the attachment and the pressing die, which annular gap is closed by devices according to the prior art, such as a seal, for example, or by attaching a closure or the paper tube to the attachment. This can prevent the tobacco from drying out inside the container and can prevent tobacco odours from escaping from inside the container.

The releasable connection mentioned in connection with the first position and with the second position of the pressing die can be established, for example, by a mechanical snap connection and/or by a magnetic connection.

The container can be designed as an element that can be attached to the guide unit.

The pressing tool can comprise a base at the end facing away from the pressing die.

DETAILED DESCRIPTION

Figure 1:
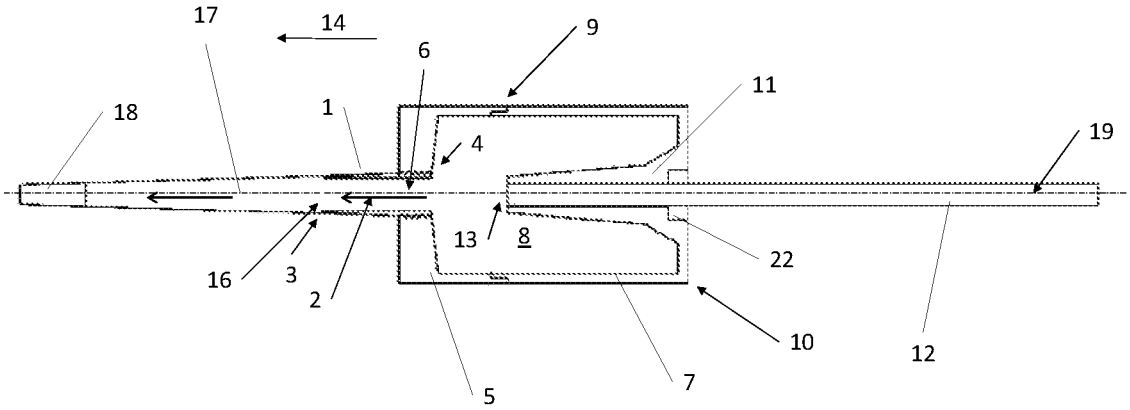
FIGS. 1 to 7 show sectional views of a possible further embodiment of the device according to the invention for filling a paper tube with tobacco, the pressing tool being in different positions.

The following elements are identified in the figures and in the following description of the figures by the preceding reference signs.

1 Attachment
2 Interior of attachment
3 First attachment end
4 Second attachment end
5 Container closure
6 Bore
7 Container
8 Container interior
9 First container end
10 Second container end
11 Guide unit
12 Pressing tool
13 Pressing die
14 Movement direction
15 Base
16 Discharge opening
17 Paper tube
18 Filter
19 Axis
20 Spring
21 Surface
22 Magnet
23 Steel ball
24 Projection The embodiment of the device according to the invention shown in FIGS. 1 to 7 comprises an attachment 1 for receiving the commercially available paper tube 17. A conical paper tube 17 is referenced in FIG. 1, although other shapes of paper tubes such as a cylindrical shape are also conceivable. The paper tube 17 is applied to the first attachment end 3 of the attachment 1. The paper tube 17 comprises a filter 18 at its free end.

The interior of the attachment 1 is designed as a cylindrical hollow body, the interior space 2 defined by the hollow attachment 1 being used to press the tobacco into the paper tube 17. The direction of pressing of the tobacco is shown in FIG. 1 by arrows.

The attachment 1 is conical on the outside, so that the paper tubes 17 can be applied with different diameters, if necessary. The conical outer shape of the attachment 1 also has the advantage that, when the paper tube 17 is applied, it is widened and/or stretched, so that the paper tube 17 shown in FIG. 1 is held by the attachment 1. The widening or stretching of the paper tube 17 also creates a normal force between the paper tube 17 and the attachment 1, which in turn creates a frictional force between the attachment 1 and the paper tube 17, via which frictional force the paper tube 17 is held on the attachment 1.

The paper tube 17 is preferably stretched tightly over the attachment 1 such that it is not pushed by the attachment 1 by the introduction and/or stuffing of tobacco into the paper tube 17. The attachment 1 has a sufficiently long length so that the user can press the paper tube 17 onto the attachment 1 with a couple of fingers, so that the paper tube 17 does not get pushed off the attachment 1 by inserting and/or stuffing the tobacco into the paper tube 17.

The attachment 1 has a smaller diameter in the area of the first attachment end 3 than the paper tube 17, shown in FIG. 1, to be applied. This allows the paper tube 17 to be easily pushed on.

The second attachment end 4 is connected to a container closure 5. The attachment 1 is screwed onto the container closure 5 by means of a thread, the container closure 5 having a bore 6 serving as a container outlet having substantially the same diameter as the interior 2 of the attachment 1.

The provision of the thread on the attachment 1 and on the container closure 5 allows the attachment 1 to be replaced simply and quickly. The user can thus screw the attachment 1 matching the paper tube 17 onto the container closure 5.

A container 7 is connected to the container closure 5 via a plug connection, in which container 7 the tobacco to be introduced into the paper tube 17 is stored. In the exemplary embodiment shown in FIGS. 1 to 7, the container space 8 is defined by the shape of the container 7 and the shape of the container closure 5. The front area of the container space 8 as seen in the direction of movement 14, which front region is formed by the container closure 5 in the embodiment shown in FIGS. 1 to 7, is designed to taper in the direction of the bore 6. This means that tobacco is prevented from collecting in the corners of the container space 8, but instead usually slides in the direction of the bore 6.

The container 7 can be plugged onto the container closure 5 with its first container end 9.

Figure 2:
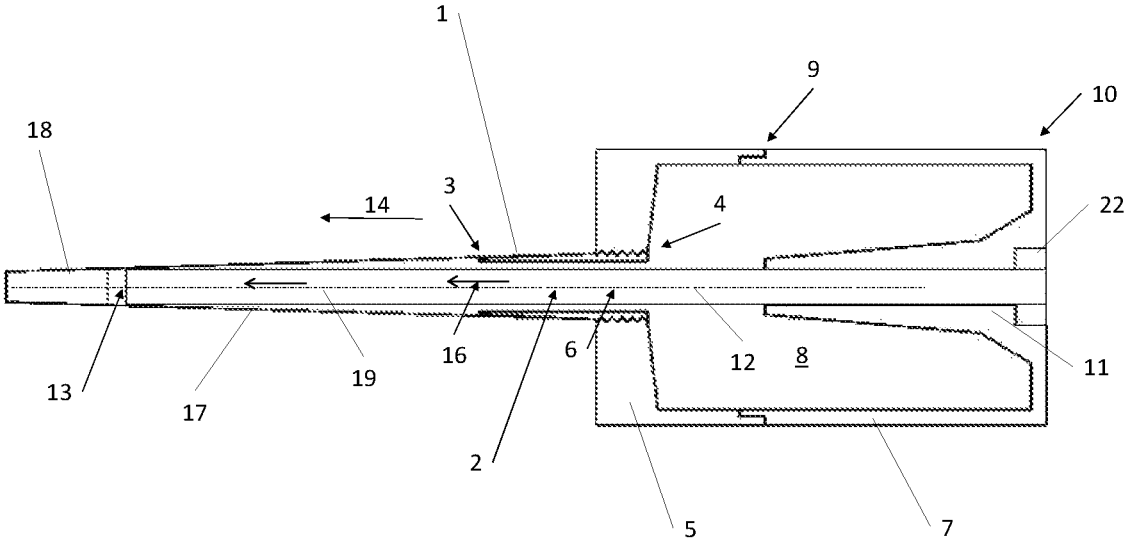
Figure 3:
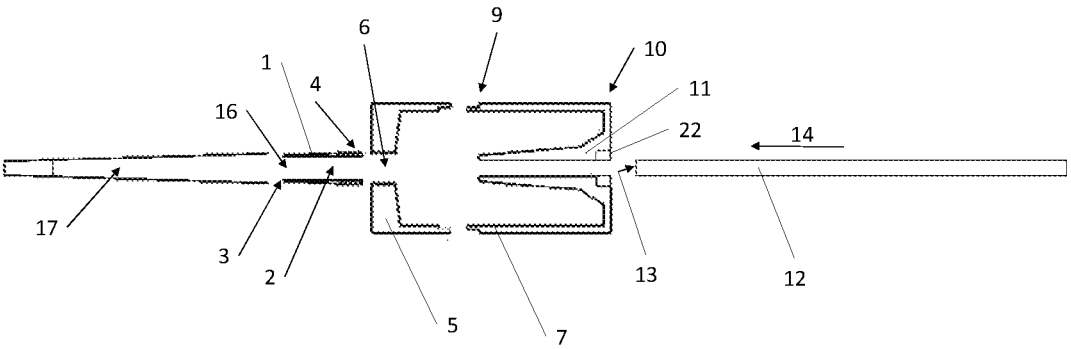

The container 7 and the container closure 5 fundamentally have the shape and the size of a commercially available cigarette box in a state that is plugged together in FIGS. 1 to 3. This has the advantage that the device according to the invention in the embodiment shown in FIGS. 1 to 7 can be sold via a cigarette machine.

At its second container end 10, which lies on the side of the container 7 facing away from the first container end 9, the container 7 comprises a guide unit 11.

The guide unit 11 is arranged in the direction of movement 14 in front of the container space 8, in front of the attachment 1 and in front of the paper tube 17. This ensures that a pressing tool 12 described below is always guided by the guide unit 11 upon contact with a tobacco mixture (not shown in the drawings). This prevents a a tobacco mixture from being spilled due to a manipulation of the pressing tool 12.

The device further comprises a pressing tool 12 which is guided by the guide unit 11. One end of the pressing tool 12 is designed as a pressing die 13, by means of which pressing die 13 the tobacco stored in the container space 8 can be received and inserted into the paper tube 17.

The pressing die 13 can be moved from a first position, in which first position the pressing die 13 has moved out of the container space 8, and a second position, in which second position the pressing die 13 has moved into the vicinity of the filter 18. The pressing die 13 located in the first position can be arranged in the region of the guide unit 11.

The direction of movement 14 of the pressing tool 12 is shown in FIG. 1 and FIG. 2 in the same way as the direction of movement 14 of the pressing die 13.

The attachment 1, the container outlet designed as a bore 6 and the guide units 11 are arranged along an axis 19, so that the paper tube 17 can be stuffed in the direction of movement 14 by moving the pressing tool 12.

The bore 6 and the inner diameter of the interior 2 of the attachment 1 have a larger diameter than the pressing die 13. This prevents tobacco and the pressing die 13 from becoming wedged in the area of the attachment 1 and/or in the area of the bore 6.

In FIG. 1, the pressing die 13 is shown in the first position. The pressing die 13 is in the area of the guide unit 11. The pressing tool 12 is releasably held in the first position by a magnet 22.

In FIG. 2, the pressing die 13 is shown in the second position. The pressing die 13 is in an area in the vicinity of the filter 18. The pressing die 13 is introduced into the paper tube 17.

Tobacco, which is not shown in FIG. 1, is stored in the container space 8. The container space 8 preferably has a shape and size so that several types of tobacco can be mixed.

The user holds the device with a tobacco stored in the container space 8 with the attachment 1 facing upwards. The tobacco stored in the container space 8 is mixed by shaking the device together with any paper tube 17 which may have been placed on it and optionally the pressing die 13 in the second position. As a result, the user can advantageously produce a homogeneous tobacco mixture.

The user holds the device with a tobacco stored in the container space 8 with the attachment 1 facing downwards, wherein the paper tube 17 is placed on the attachment 1 and the pressing die 13 is in the first position. The tobacco falls into the paper tube 17 by means of gentle shaking.

By moving the pressing tool 12 from the first position into the second position (see FIG. 2), the pressing die 13 is moved through at least a partial area of the interior 8 of the container. By moving the pressing die 13 in the direction of movement 14 through a tobacco held in the container interior 8, a quantity of tobacco defined by the size of the pressing die 13 can be taken up. It is substantially the amount of tobacco that accumulates on the pressing die 13. By moving the pressing die 13 in the direction of movement 14, it can be compressed in the paper tube 17 and thus stuffed.

The movement of the tobacco through the attachment 1 and into the paper tube 17 is shown by arrows in FIGS. 1 and 2. The tobacco is introduced into the paper tube 17 via the discharge opening 16.

The paper tube 17 is held at least on the edge of the paper tube which is arranged adjacent to the attachment 1. As a result, the paper tube 17 experiences only a tensile load when the tobacco is introduced and cannot buckle. Furthermore, the tobacco is introduced centrally into the interior of the paper tube 17.

The pressing tool 12 can be removed from the guide unit 11. As a result, the user can easily clean the pressing tool 12.

FIG. 3 shows an exploded drawing of the embodiment shown in FIGS. 1 to 8 together with the paper tube 17.

Figure 4:
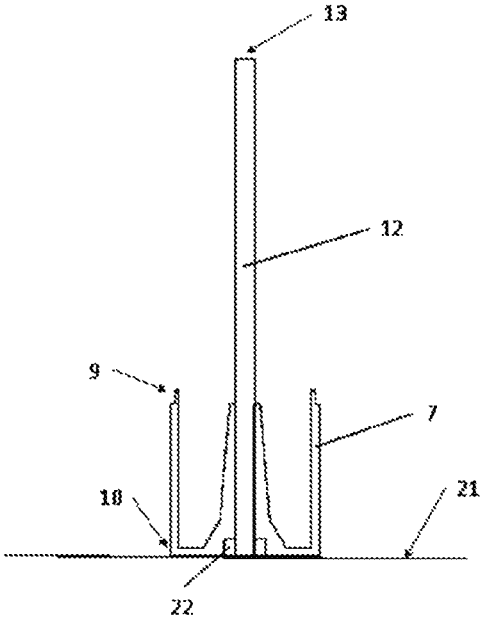

FIG. 4 shows the embodiment shown in FIGS. 1 to 7 in a possible configuration for filling the container 7. The container closure 5 together with the attachment 1 have been removed. The pressing tool 12 is brought into the second position, so that the container 7 can be placed on a surface 21. The pressing tool 12 is releasably held in this second position by a magnet 22. The container 7 is stable on the surface 21.

Figure 5:
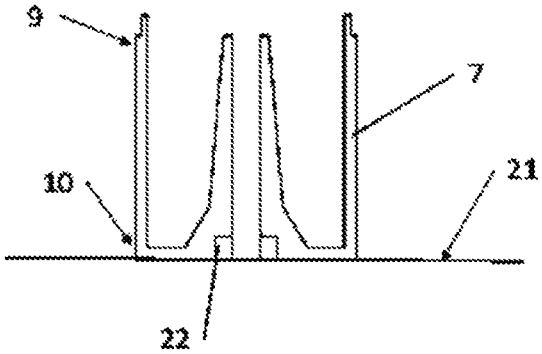

FIG. 5 also shows the embodiment shown in FIGS. 1 to 7 in a further configuration for filling the container 7. The container closure 5 together with the attachment 1 is again removed. Furthermore, the pressing tool 12 is removed, so that the pressing tool 12 is not a hindrance when filling the container 7.

Figure 6:
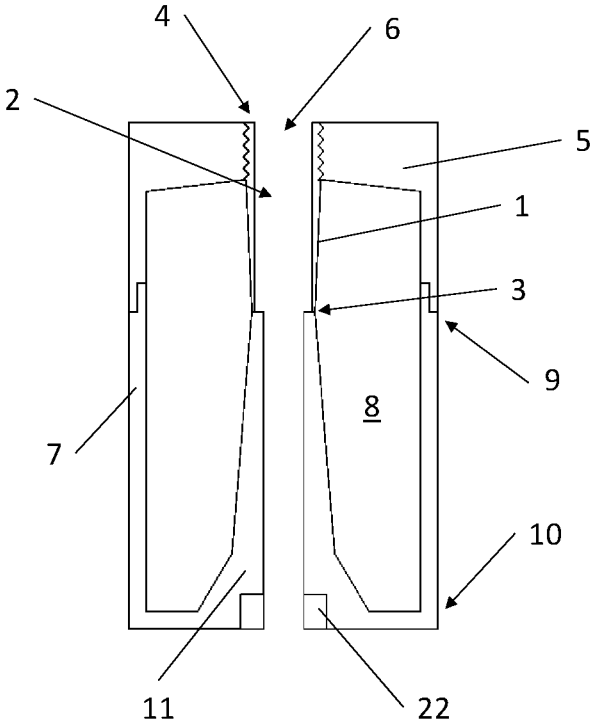

FIG. 6 shows the embodiment shown in FIGS. 1 to 7 in a possible transport configuration of container 7, container closure 5 and attachment 1. The pressing tool 12 has been removed and is therefore not shown in FIG. 6.

The container 7 and the container closure 5 are interconnected to form a container interior 8. The attachment 1 is screwed into the bore 6 in a position opposite to that in FIG. 1 and FIG. 2, so that the attachment 1 contacts the guide unit 11 with its first attachment end 3. The contact between the first attachment end 3 and the guide unit 11 is so tight that no tobacco, which is not shown in FIG. 6, can escape from the interior 8 of the container.

The pressing tool 12 can advantageously be dismantled or telescopically constructed in a partial area, so that the pressing tool 12 can be transferred from a position of use, which is shown in the figures, to a storage position that is not shown in the figures. The length of the storage position of the pressing tool 12 has a maximum length, at which length the pressing tool 12 located in the storage position can be inserted into the container space 8, the container space 8 being closable by plugging the container closure 5 onto the container 7.

Figure 7:
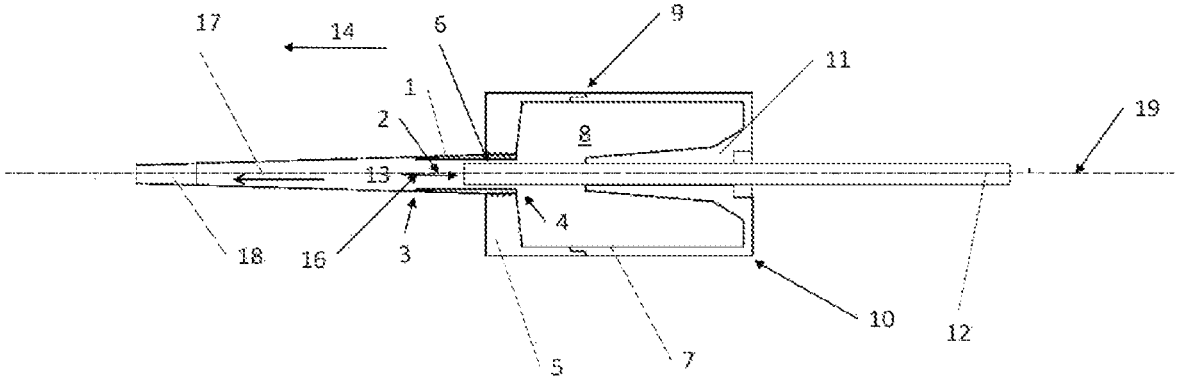

FIG. 7 shows the embodiment of the device according to the invention shown in FIGS. 1 to 7 during the stuffing process. Here, the pressing tool 12 is moved in the direction of movement 14 through the interior 2 of the attachment, the tobacco introduced into the paper tube 17 being stuffed by pressing against the filter 18. The paper tube 17 holding the filter 18 is held by the friction acting between the paper tube 17 and the attachment 1. Alternatively, the user presses the paper tube 17 against the attachment 1 in order to prevent the paper tube 17 from slipping off the attachment 1.

Figure 8:
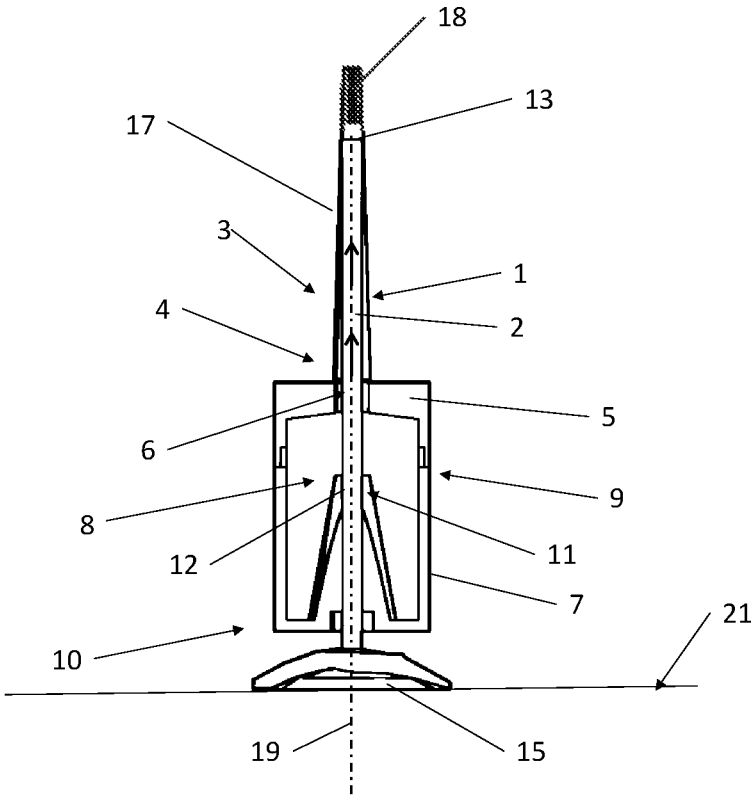
FIG. 8 and FIG. 9 show sectional images of a further embodiment of the device according to the invention.
Figure 9:
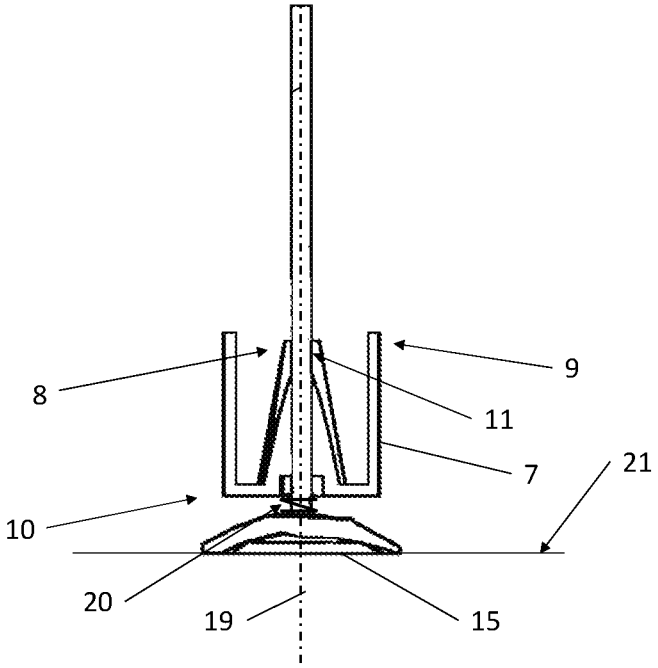

FIG. 8 and FIG. 9 show sectional images of a further embodiment of the device according to the invention. The device shown in FIGS. 8 and 9 is constructed substantially like the device shown in FIGS. 1 to 7; in addition to the features of the device of FIGS. 1 to 7, the device shown in FIGS. 8 and 9 comprises a base 15, on which base the device according to the invention can be placed on a surface 21 with an attachment 1 pointing upwards.

FIG. 8 shows the entire device together with paper tube 17 in a storage position on the base 15. In this position, the container closure 5 can easily be taken off the container 7 and removed together with the attachment 1. The container 7 is thereby opened and can be filled with tobacco or a tobacco mixture. The device stored on the base 15 can be stored in this way. The discharge opening 16 can advantageously be closed by a suitable closure or by a paper tube 17 in order to prevent the tobacco from drying out.

FIG. 9 shows the device according to the invention in a possible configuration for filling the container 7. The container closure 5 with the attachment 1 and paper tube 17 is removed. The container 7 stored on the base 15 is stably supported such that the tobacco mixture stored in the container interior 8 can be processed. The tobacco mixture can, for example, be stirred in the container interior 8 with a mortar (not shown in FIG. 9) or further broken up.

The pressing tool 12 further comprises a spring 20, which spring 20 is compressed by the tobacco introduced into the container space 8. The weight of the tobacco held in the container space 8 can be determined via a scale (not shown in FIG. 9) applied to the pressing tool 12 and a displacement of the container 7 relative to the pressing tool 12 due to the weight of the tobacco stored in the container space 8.

FIGS. 10 to 15 show a further embodiment of the device according to the invention, which is similar to the embodiment shown in FIGS. 1 to 7.

Figure 10:
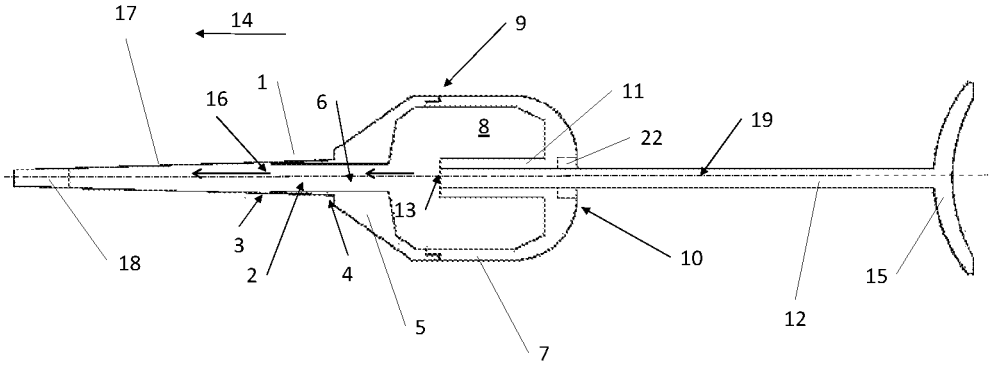
FIGS. 10 to 19 show a further embodiment of the device according to the invention or parts of this device.
Figure 15:
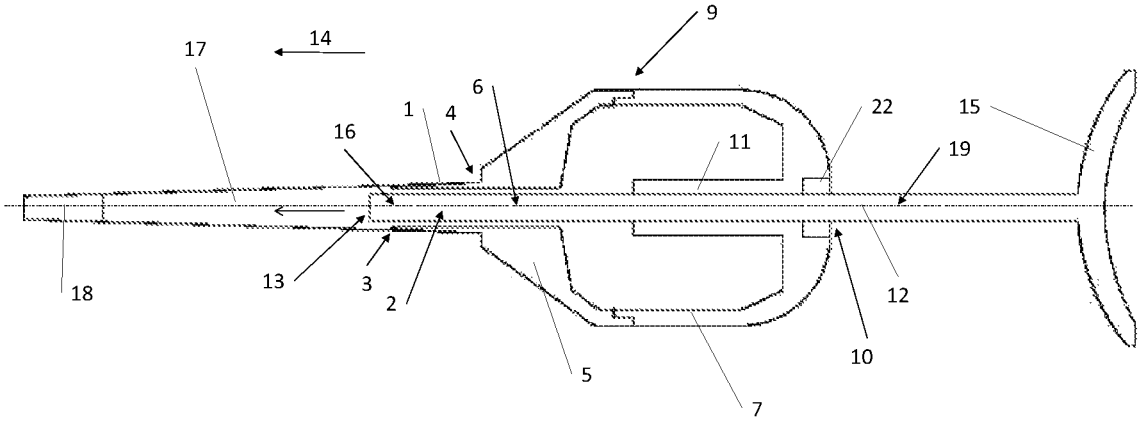

In contrast to the embodiment shown in FIGS. 1 and 2, in which the container 7 and the container closure 5, when plugged together, have a shape that is similar to a commercially available cigarette box and thus a cuboid shape, form a cylinder in the embodiment shown in FIGS. 10 and 15 of the container 7 and the container closure 5. Furthermore, the attachment 1 and the container closure 5 are formed in one piece. The person skilled in the art can also design the attachment 1 and the container closure 5 in two parts, but this is not shown in the figures mentioned.

FIG. 10 shows the embodiment with a pressing tool 12 in the first position. The pressing tool 12 is held releasably in this first position by a magnet 22.

Figure 11:
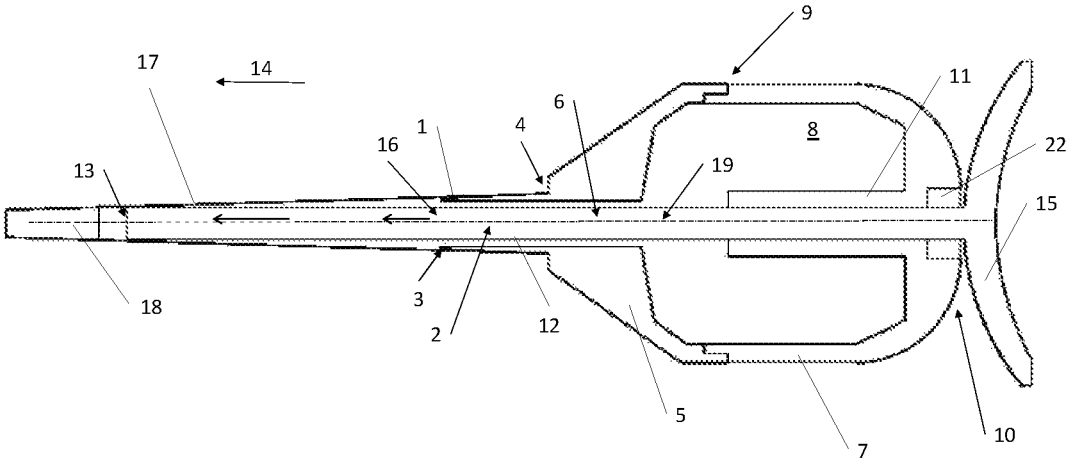

FIG. 11 shows the embodiment with a pressing tool 12 in the second position.

Figure 12:
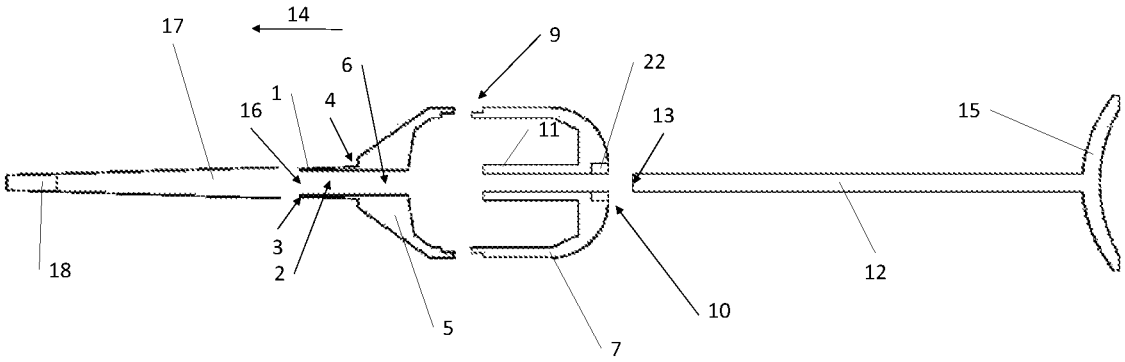

FIG. 12 shows an exploded view of the embodiment.

Figure 13:
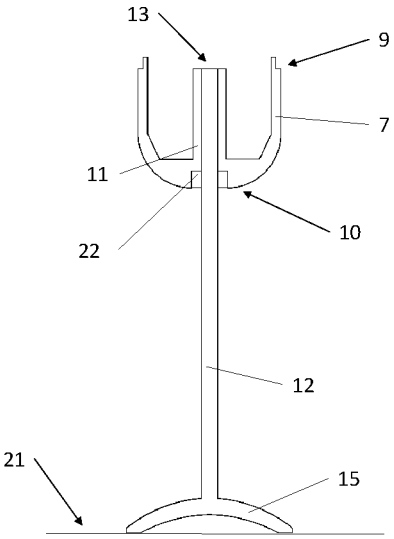
Figure 14:
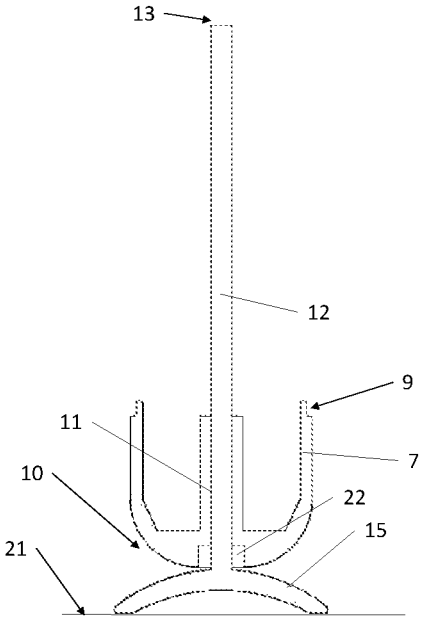

FIG. 13 and FIG. 14 again show possible configurations of the embodiment for filling the container 7. The embodiment further comprises a connection which can be released by the arrangement of a magnet 22 for locking the pressing tool 12 in the first position and in the second position. This enables the configuration shown in FIG. 13 to be achieved.

FIG. 15 shows the embodiment when the paper tube 17 is stuffed.

Figure 16:
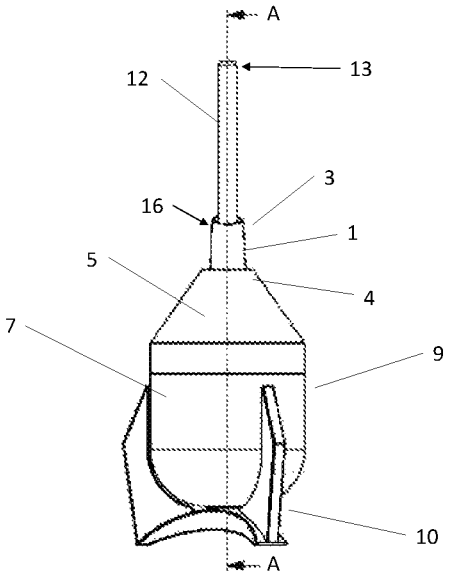

FIG. 16 shows a view of a further embodiment of the device according to the invention for introducing tobacco into a paper tube not shown in FIG. 16.

Figure 17:
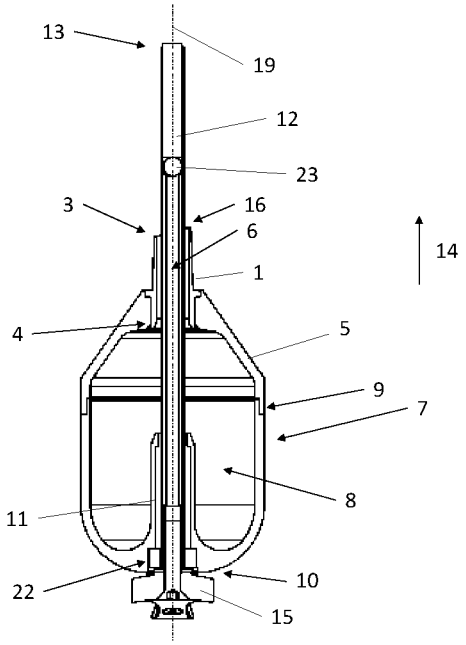

The device comprises a container 7, in the interior of which the tobacco can be stored (not shown in FIG. 16). An attachment 1 is connected to the container 7 via the container closure 5, so that the tobacco stored in the container 7 can be discharged through a discharge opening 16. This process takes place by means of a pressing tool 12, in a similar process to that described above. The pressing tool 12 extends through the container 7 and, at its end remote from a pressing die 13, comprises a base 15, by means of which the user can simply set down the device. The details of the device shown in the view of FIG. 16 can be found in the sectional drawing in FIG. 17. FIG. 17 shows a sectional view of the device shown in FIG. 16 along the section axis A-A shown in FIG. 16.

FIG. 17 shows a sectional view of the device according to the invention for introducing tobacco.

The device comprises a container 7, in the container interior 8 of which the tobacco can be stored. The device according to the invention is distinguished in particular by the fact that the tobacco is sealed off in the container interior and is therefore stored substantially at a constant moisture level. The constant moisture is achieved by the tight seal and not by the material properties of the workpiece, from which workpiece the container is made. The container can be made of a metal or plastic, for example.

A container closure 5 is applied to the first container end 9 of the container 7. For this purpose, the person skilled in the art can provide a plug connection, a thread or a similar, preferably mechanical connection. If a thread is formed, the person skilled in the art can provide a stepped thread, which facilitates the placement of the container closure 5 on the container 7.

Figure 19:
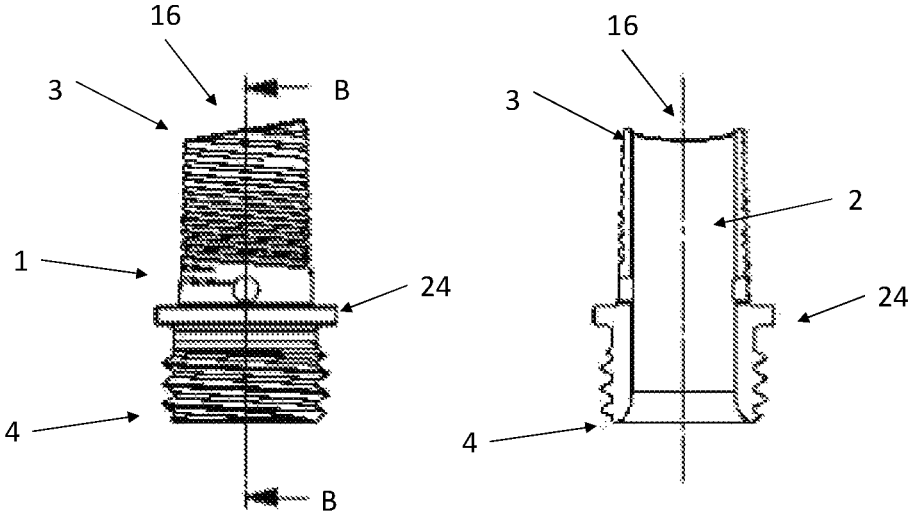

An attachment 1 is applied to the container closure 5, a possible embodiment of the attachment 1 being shown in detail in FIG. 19. The person skilled in the art is able to provide a suitable detachable connection between the container closure 5 and the attachment 1, for example a plug connection or a thread. Again, a stepped thread can be provided, which in turn makes it easier to place the attachment 1 on the container closure 5.

While the attachment 1 contacts the container closure 5 with its second attachment end 4, the attachment 1 is in contact with the first attachment end 3 with a paper tube, not shown in this figure, into which paper tube the tobacco stored in the container interior 8 is to be inserted.

The tobacco is introduced into the paper tube—similar to the previously described devices—by means of a pressing tool 12 and/or by shaking the device according to the invention with a paper tube placed on the attachment 1, the device together with the paper tube being directed in such a way that the paper tube is arranged below the container 7. FIG. 17 shows the pressing tool 12 in its second position, in which second position the pressing die 13 is inserted into the paper tube (not shown). In any case, the pressing die 13 is located outside the device, i.e. outside the container interior 8 and outside the attachment 1.

The container 7 comprises a guide unit 11 for guiding the pressing tool 12. The guide unit 11 and the pressing tool 12 contact each other so that a tight seal can be achieved in this area. The person skilled in the art provides for a sufficient guide length of the guide unit 11, so that the tight seal in this area and clean guidance by the guide unit 11 is ensured. For this reason, the container 7 has in this area a shape of a rotating body extending into the container interior 8. This rotating body of the container 7 is further shaped such that when the device is in a standing position (see FIG. 16), the tobacco can be stored laterally to the guide unit 11 and thus the tobacco cannot escape.

By mounting the pressing tool 12 by means of the guide unit 11, the attachment 1, the container outlet and the guide unit 11 are arranged along an axis 19. This allows simple operation of the device, especially since the movement 14 of the pressing tool 12 takes place parallel to the axis 19.

A stand 15 is connected to the end of the pressing tool 12 facing away from the pressing die 13. The device is possible by means of this base 15 in a secure and standing mounting of the device, as shown in FIG. 16.

The pressing tool 12 comprises a steel ball 23. In a first position of the pressing tool 12 (FIG. 17 shows the device in the second position of the pressing tool), this steel ball is in engagement with a magnet 22 arranged in the region of the guide unit 11, as a result of which the pressing tool 12 and the container 7 are locked to one another.

Figure 18:
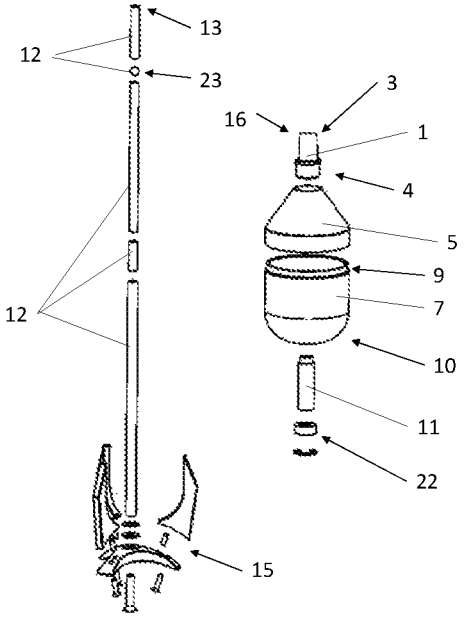

In addition to FIG. 17, FIG. 18 shows an exploded drawing of the device shown in FIG. 16 and FIG. 17.

FIG. 19 shows details of the attachment 1 with the first attachment end 3 and the second attachment end. FIG. 19 shows a view (left) and a sectional view along the section line B-B.

The second attachment end 4 comprises a thread for screwing to the container closure (not shown). The screwing into the container closure is limited by the projection 24, which projection 24 contacts the outer surface of the container closure 5 and creates a tight connection.

The first attachment end 3 likewise comprises a thread, onto which thread the paper tube (not shown in FIG. 19) can be pushed or screwed on. This thread creates a friction bond between the attachment 1 and the paper tube. The attachment 1 is conically shaped in the area between the first attachment end 3 and the projection 24 on its outer surface. The conical paper tube is preferably applied to the attachment 1 up to the projection 24.

In the area of the second attachment end 4, the inner surface has a chamfer in order to facilitate the introduction of the tobacco from the container interior 8 into the interior of the attachment 2 and further to the discharge opening 16 and consequently into the paper tube 17 via the interior 2 of the attachment 1.

The invention claimed is:

1. A device for filling a paper tube with tobacco, comprising:

an attachment for receiving the paper tube;

a pressing tool guided by a guide unit with a pressing die; and a container for receiving the tobacco with a container outlet, a container seal closure for defining a container interior being attached onto the container and comprising the container outlet;

wherein the pressing die is movable from a first position, in which first position the container outlet is unblocked, into a second position for introducing the tobacco into the paper tube;

wherein the attachment, the container outlet, and the guide unit are arranged along an axis, the guide unit extending into the container interior and enclosed within the container;

wherein the tobacco stored in the container interior is introducible into the attachment via the container outlet; and wherein the attachment is detachably coupled to the container, the attachment configured to be reversibly attachable to the container for traveling with a first attachment end extending into the container interior; and the guide unit contacts the first attachment end when the attachment is reversibly attached to the container for traveling.

2. The device according to claim 1, wherein the attachment has a smaller diameter than the paper tube at least at the first attachment end.

3. The device according to claim 2, wherein:

the attachment at the first attachment end has a conical shape on an outside; and the paper tube, when attached to the first attachment end, is attachable by generating a frictional connection between the paper tube and the attachment.

4. The device according to claim 3, wherein the attachment comprises a thread for creating a frictional connection between the attachment and the container, the thread being on an outer surface of a second attachment end opposite the first attachment end.

5. The device according to claim 1, wherein the pressing die is configured to be locked in the first position and in the second position relative to the container.

6. The device according to claim 1, wherein the container can be fastened to the guide unit.

7. The device according to claim 1, wherein the pressing tool comprises a base at an end facing away from the pressing die, the base having a first lateral cross-section larger than a second lateral cross-section of the container.

8. The device according to claim 7, wherein the device is configured to stand on the base when the base is placed on a flat surface.

9. The device according to claim 1, wherein the device comprises one of plastic, metal, and wood.

10. The device according to claim 1, wherein the pressing tool and the container are locked to one another by a magnetic connection.

11. The device according to claim 10, wherein a magnet is arranged on the container and a steel ball is arranged on the pressing tool, the magnet being arranged to engage with the steel ball.

12. The device according to claim 1, wherein the guide unit contacts the first attachment end when the attachment is reversibly attachable to the container for traveling in a tight manner preventing the tobacco stored in the container interior from escaping the container.

13. A device for filling a paper tube with tobacco, comprising:

a container for receiving the tobacco into a container interior, the container having a container outlet;

an attachment configured to be detachably coupled to the container at the container outlet in a first orientation for filling the paper tube with the tobacco from the container interior and a second orientation for traveling that prevents the tobacco stored in the container interior from escaping the container; and a pressing tool guided by a guide unit with a pressing die, the pressing tool configured to travel along an axis of the attachment and the guide unit, the pressing tool configured to press the tobacco stored in the container interior into the attachment when the attachment is coupled to the container in the first orientation and when the paper tube is received on a first end of the attachment;

wherein when the attachment is coupled to the container in the first orientation, the first end is configured to extend into the paper tube and the pressing tool is configured to press the tobacco into the paper tube when the pressing tool presses the tobacco stored in the container interior into the attachment; and when the attachment is coupled to the container in the second orientation, the first end extends into the container interior and the guide unit extends into the container interior and contacts the first end in a tight manner.

14. The device according to claim 13, wherein the attachment has a smaller diameter than the paper tube at least at the first end.

15. The device according to claim 13, wherein:

the first end has a conical shape on an outside; and the paper tube is attachable to the first end by generating a frictional connection between the paper tube and the first end.

16. The device according to claim 13, wherein the attachment comprises a thread for creating a frictional connection between the attachment and the container, the thread being on an outer surface of a second end opposite the first end.

17. The device according to claim 13, wherein:

the pressing tool comprises a base at an end facing away from the pressing die, the base having a first lateral cross-section larger than a second lateral cross-section of the container; and the device is configured to stand on the base when the base is placed on a flat surface.

18. The device according to claim 13, wherein:

the pressing tool and the container are locked to one another by a magnetic connection; and a magnet is arranged on the container and a steel ball is arranged on the pressing tool, the magnet being arranged to engage with the steel ball.

* * * * *